US011774137B1

(12) United States Patent
Bush et al.

(10) Patent No.: US 11,774,137 B1
(45) Date of Patent: Oct. 3, 2023

(54) COIL ASSEMBLY FOR AN AIR CONDITIONER AND METHOD FOR ASSEMBLING THE SAME

(71) Applicant: Mitsubishi Electric US, Inc., Cypress, CA (US)

(72) Inventors: Joseph Paul Bush, Lawrenceville, GA (US); Allen Barbely, Winder, GA (US)

(73) Assignee: MITSUBISHI ELECTRIC US, INC., Cypress, CA (US)

( * ) Notice: Subject to any disclaimer, the term of this patent is extended or adjusted under 35 U.S.C. 154(b) by 37 days.

(21) Appl. No.: 17/710,191

(22) Filed: Mar. 31, 2022

(51) Int. Cl.
*F24F 13/30* (2006.01)
*F24F 13/22* (2006.01)
*F24F 3/153* (2006.01)

(52) U.S. Cl.
CPC ..... *F24F 13/222* (2013.01); *F24F 3/153* (2013.01); *F24F 13/30* (2013.01)

(58) Field of Classification Search
CPC ..... F24F 3/153; F24F 13/30; F24F 13/222
See application file for complete search history.

(56) References Cited

U.S. PATENT DOCUMENTS

| | | | | |
|---|---|---|---|---|
| 7,980,087 | B2 | 7/2011 | Anderson et al. | |
| 9,599,353 | B2 * | 3/2017 | Cur | F25B 41/00 |
| 10,801,742 | B2 | 10/2020 | Goel et al. | |
| 10,962,243 | B2 | 3/2021 | Bush et al. | |
| 2006/0064995 | A1 * | 3/2006 | Rigal | F25B 45/00 62/149 |
| 2017/0067676 | A1 * | 3/2017 | Munk | F25B 41/20 |
| 2017/0153037 | A1 * | 6/2017 | Goel | F25B 41/42 |
| 2018/0094841 | A1 * | 4/2018 | Kester | F25B 41/34 |

FOREIGN PATENT DOCUMENTS

| | | |
|---|---|---|
| CN | 2756993 Y | 2/2006 |
| CN | 210118895 U | 2/2020 |
| CN | 210772484 U | 6/2020 |

OTHER PUBLICATIONS

Nortek Air Solutions, [online], "Desaturation Coil", Nortek Air Solutions, LLC, Internet URL: https://www.nortekair.com/wp-content/uploads/2016/12/239f.pdf, 2018, [retrieval date Mar. 31, 2022].

Siegel, [online], "Dehumidification and Reheat in One Coil", The Air Conditioning | Heating | Refrigeration News, Internet URL: https://www.achrnews.com/articles/89890-dehumidification-and-reheat-in-one-coil, Mar. 3, 2004, [retrieval date Mar. 31, 2022].

* cited by examiner

*Primary Examiner* — Filip Zec
(74) *Attorney, Agent, or Firm* — POSZ LAW GROUP, PLC

(57) ABSTRACT

A coil assembly is provided, comprising: a direct expansion (DX) coil circulating refrigerant and cooling supply air passing over the DX coil by heat exchange to generate dehumidified air; a reheat coil circulating the refrigerant and heating the dehumidified air by heat exchange to generate output air; a first horizontal drain pan below the DX and reheat coils in a first horizontal position; a second horizontal drain pan below the DX and reheat coils in a second horizontal position; a first vertical drain pan below the DX and reheat coils in a vertical position, wherein the first and second horizontal drain pans are connected to the first vertical drain pan, the reheat coil is secured between the first and second horizontal drain pans, and the first horizontal drain pan is on an opposite side of the DX coil and the reheat coil from the second horizontal drain pan.

20 Claims, 11 Drawing Sheets

COIL ASSEMBLY FOR AN AIR CONDITIONER AND METHOD FOR ASSEMBLING THE SAME

TECHNICAL FIELD

The disclosed systems and methods relate generally to a coil assembly for an air conditioner and a method for assembling the same. More particularly, the disclosed systems and methods relate to a coil assembly with at least one vertical drain pan formed below the coil assembly and two horizontal drain pans formed on opposite sides of the direct expansion coil. The drain pans are secured to each other and to the direct expansion coil to form the coil assembly and a reheat coil is secured within the coil assembly between the two horizontal drain pans, thereby providing a compact coil assembly that can be arranged in at least three different positions that all allow for the proper drainage of condensation.

BACKGROUND

An air-conditioning system will generally include an indoor air conditioner unit that operates to exchange heat between a refrigerant passing through the indoor air conditioner unit and indoor air in an indoor space. In many systems, the indoor air conditioner unit will include a direct expansion coil for circulating heated or cooled refrigerant. The direct expansion coil is arranged so that the inside air can be passed over it for a heat exchange operation that will condition the air.

In a heating operation, the refrigerant passing through the direct expansion coil is hotter than the inside air, allowing the heat exchange operation to make the inside air warmer. In a cooling operation, the refrigerant passing through the direct expansion coil is cooler than the inside air, allowing the heat exchange operation to make the inside air cooler.

When the air-conditioning system is performing a cooling operation, the temperature of the refrigerant in the direct expansion coil may be set to be cold enough that it will draw moisture out of the indoor air by condensation as the inside air passes over the direct expansion coil. This allows the indoor air conditioner unit to dehumidify the indoor air as it is being conditioned. Such a dehumidification process can be desirable if the conditions are such that unconditioned air could have a high humidity as is common in many hot locations.

However, while the dehumidification process has the desirable effect of removing moisture from the indoor air, it has two undesirable effects as well. First, the indoor air must often be cooled to a temperature lower than a desired set temperature for the indoor space in order to be cold enough to dehumidify the indoor air; and second, the moisture drawn from the air must be routed from the direct expansion coil in such a way that it does not harm any portion of the indoor air conditioner unit or leak in an undesirable way into the indoor space.

An indoor air conditioner unit may include a reheat coil to address this first effect. The reheat coil is provided in a position that allows it to heat the cooled indoor air after the direct expansion coil has cooled it to a temperature low enough for dehumidification. The reheat coil acts to heat the cooled indoor temperature to a temperature that will achieve the desired set point temperature for the indoor space.

A drain pan can be provided in the indoor air conditioner unit to help route the water condensed from the indoor air. This drain pan will be arranged beneath the direct expansion coil such that it can catch any water that drips from the direct expansion coil and channel that water to a suitable location such as an indoor drain.

In various installation locations, an indoor air conditioner unit may have to be fit into small or oddly shaped locations. Depending upon the locations in which it must be installed, there can be significant limitations regarding the size and shape of the indoor air conditioner unit. However, it can be expansive and impractical for a company to design, produce, and sell too many different indoor air conditioner units.

It is therefore desirable to provide an indoor air conditioner unit in an air conditioning system that is both compact and flexible in how it can be oriented so that it can be used in multiple different installation configurations.

SUMMARY OF THE INVENTION

According to one or more embodiments, A coil assembly for an air conditioner is provided, comprising: a direct expansion coil configured to circulate refrigerant and cool supply air passing over the direct expansion coil by heat exchange between the refrigerant and the supply air to generate dehumidified air; a reheat coil configured to circulate the refrigerant to heat the dehumidified air by heat exchange between the refrigerant and the supply air to generate output air; a first horizontal drain pan configured to be located below the direct expansion coil and the reheat coil when the air conditioner is in a first horizontal position; a second horizontal drain pan configured to be located below the direct expansion coil and the reheat coil when the air conditioner is in a second horizontal position; a first vertical drain pan configured to be located below the direct expansion coil and the reheat coil when the air conditioner is in a vertical position; wherein the first and second horizontal drain pans are connected to the first vertical drain pan, the reheat coil is secured between the first and second horizontal drain pans, the direct expansion coil is a hot-gas direct expansion coil, and the first horizontal drain pan is arranged on an opposite side of the direct expansion coil and the reheat coil from the second horizontal drain pan.

The coil assembly may further comprise: one or more fasteners configured to secure the direct expansion coil to the first vertical drain pan.

The first horizontal drain pan may include a first shelf extending between two first horizontal drain pan walls and configured to create a first recess, the second horizontal drain pan may include a second shelf extending between two second horizontal drain pan walls and configured to create a second recess, a first end of the reheat coil may be inserted into the first recess, a second end of the reheat coil may be inserted into the second recess, and the first and second horizontal drain pans may be secured to the first vertical drain pan such that the reheat coil is held in place by the first and second recesses.

The first shelf may be formed to be contiguous with at least two walls of the first horizontal drain pan, and the second shelf may be formed to be contiguous with at least two walls of the second horizontal drain pan.

The first vertical drain pan may include: a plurality of outer walls, a plurality of inner walls, and a first vertical drain pan bottom formed in an area between the plurality of outer walls and the plurality of inner walls. An opening may be formed below the direct expansion coil between the plurality of inner walls, and first and second portions of the direct expansion coil may be secured to corresponding walls selected from the plurality of outer walls and the plurality of inner walls in the area between the plurality of outer walls and the plurality of inner walls.

The coil assembly may further comprise: one or more fasteners configured to secure the direct expansion coil to the corresponding walls selected from the plurality of outer walls and the plurality of inner walls.

The first horizontal drain pan may be secured to the first vertical drain pan proximate to the first portion of the direct expansion coil, and the second horizontal drain pan may be secured to the first vertical drain pan proximate to the second portion of the direct expansion coil.

The coil assembly may further comprise: a second vertical drain pan configured to be located between the direct expansion coil and the reheat coil, wherein a first width of the first vertical drain pan in a width direction between the first horizontal drain pan and the second horizontal drain pan extends substantially an entire distance between the first horizontal drain pan and the second horizontal drain pan, and a second width of the second vertical drain pan in the width direction is narrower than the first width of the first vertical drain pan.

The refrigerant may be configured to change state between liquid and vapor during an air-conditioning cycle that passes the refrigerant through the direct expansion coil and the reheat coil.

A first horizontal drain pan bottom of the first horizontal drain pan and a second horizontal drain pan bottom of the second horizontal drain pan may both be substantially perpendicular to a first vertical drain pan bottom of the first vertical drain pan.

The reheat coil may be set apart from the direct expansion coil. In some embodiments, the reheat coil may be arranged between 1 inch and 6 inches apart from the direct expansion coil.

The direct expansion coil may be an A-coil.

The first and second horizontal drain pans may be substantially the same size and shape.

An air conditioner can be provided, comprising the above coil assembly, a blower configured to blow input air across the coil assembly, a controller configured to control operation of the coil assembly and the blower, and an air conditioner casing formed around the coil assembly, the blower, and the controller.

The blower may be located below the coil assembly when the air conditioner is in the vertical position, or it may be located above the coil assembly when the air conditioner is in the vertical position.

A drain pan is provided for use in an air conditioner, comprising: a drain pan bottom; a first drain pan wall formed along a first side of the drain pan bottom; a second drain pan wall formed along a second side of the drain pan bottom; a third drain pan wall formed along a third side of the drain pan bottom; a fourth drain pan wall formed along a fourth side of the drain pan bottom; a drain hole formed in one of the first through fourth drain pan walls; and an interior drain pan wall extending between the third and fourth drain pan walls to divide an interior of the drain pan into a drain area and a coil recess, wherein the coil recess is isolated from the drain area such that liquid cannot flow from the drain area into the coil recess.

A drain length of the drain area in a length direction between the first wall and the second wall may be greater than a recess length of the coil recess in the length direction.

A method of assembling a coil assembly for an air conditioner is provided, comprising: securing a direct expansion coil to a first vertical drain pan; securing a first horizontal drain pan to a first side of the first vertical drain pan; inserting a first end of a reheat coil into a first recess in the first horizontal drain pan; and securing a second horizontal drain pan to a second side of the first vertical drain pan opposite the first side of the first vertical drain pan such that a second end of the reheat coil is inserted into a second recess in the second horizontal drain pan, wherein the first and second horizontal drain pans are secured to the first vertical drain pan in such a manner that the reheat coil is held in place by the first and second recesses.

The first and second horizontal drain pans may be secured to the first vertical drain pan such that the direct expansion coil is located between the first horizontal drain pan and the second horizontal drain pan.

The first horizontal drain pan may be secured to the first vertical drain pan such that a first horizontal drain pan bottom of the first horizontal drain pan is substantially perpendicular to a first vertical drain pan bottom of the first vertical drain pan, and the second horizontal drain pan may be secured to the first vertical drain pan such that a second horizontal drain pan bottom of the second horizontal drain pan is substantially perpendicular to the first vertical drain pan bottom of the first vertical drain pan.

The method may further comprise: securing a second vertical drain pan to at least one of the first horizontal drain pan and the second horizontal drain pan such that the second vertical drain pan is formed on an opposite side of the direct expansion coil from the first vertical drain pan.

BRIEF DESCRIPTION OF THE DRAWINGS

The accompanying figures, where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

Coil Assembly

Figure 1:
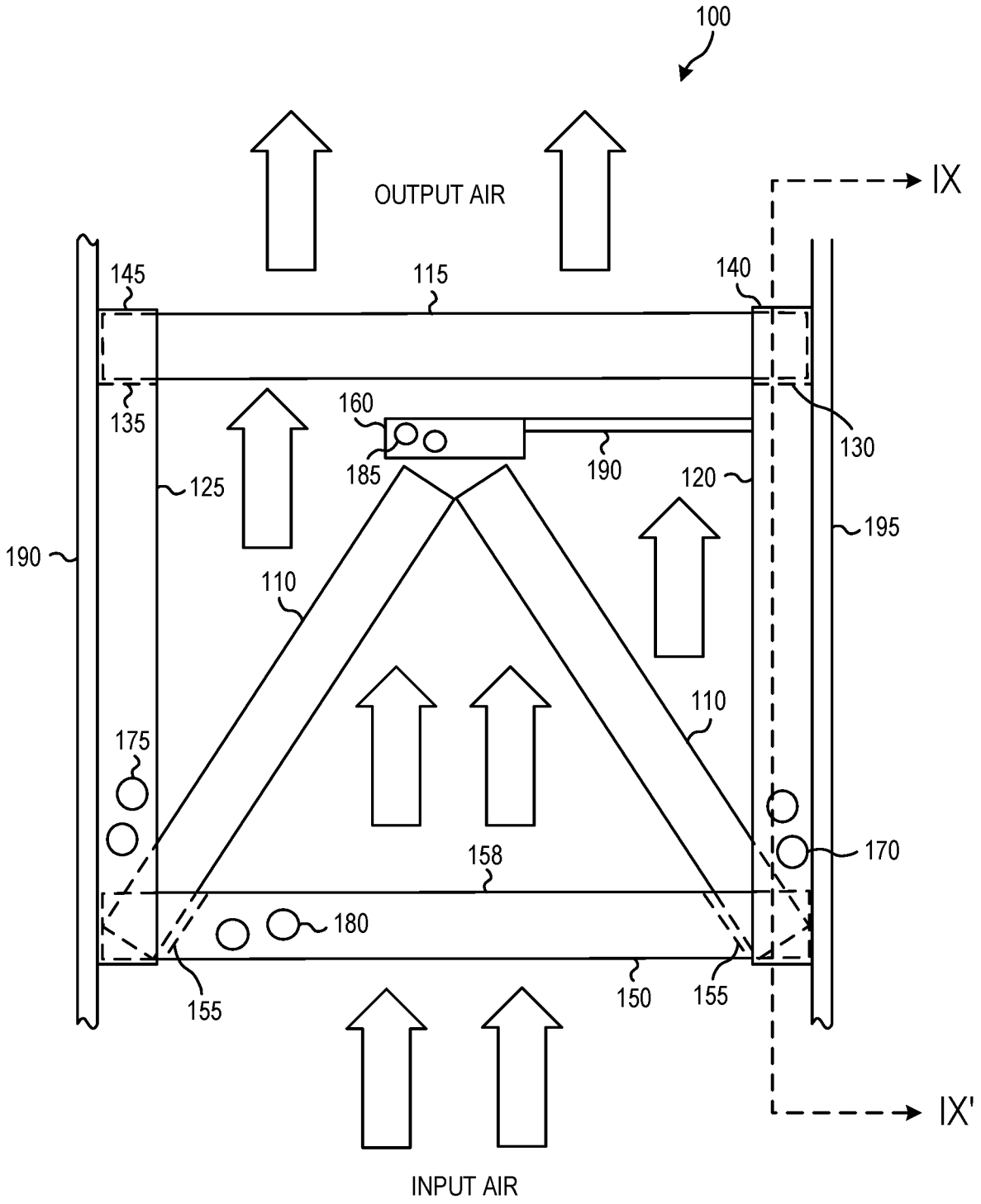
FIG. 1 is a diagram of a coil assembly for an air conditioner in a first orientation according to disclosed embodiments.

FIG. 1 is a diagram of a coil assembly 100 for an air conditioner in a first orientation according to disclosed embodiments. As shown in FIG. 1, the coil assembly 100 includes a direct expansion coil 110, a reheat coil 115, a first horizontal drain pan 120, a second horizontal drain pan 125, a first vertical drain pan 150, a second vertical drain pan 160, and a support beam 190. The first horizontal drain pan 120 further includes a first shelf 130 that defines a first recess 140 and one or more first horizontal drain pan drains 170. The second horizontal drain pan 125 further includes a second shelf 135 that defines a second recess 145 and one or more second horizontal drain pan drains 175. The first vertical drain pan 150 includes a plurality of slanted drain pan walls 155 that define an opening 158 and one or more first vertical drain pan drains 180. The second vertical drain pan 160 includes one or more second vertical drain pan drains 185. The elements in the coil assembly 100 can be formed in an air conditioner casing 195.

In the first orientation, the direct expansion coil 110 and the reheat coil 115 are both arranged over the first vertical drain pan 150. For purposes of this disclosure, this first orientation will be considered a first vertical orientation. The vertical direction will be considered a direction passing between the first vertical drain pan 150 and the second vertical drain pan 160; and the horizontal direction will be considered a direction passing between the first horizontal drain pan 120 and the second horizontal drain pan 125.

The direct expansion coil 110 is an evaporator coil that operates as a heat exchanger. It works together with an outdoor air conditioner or heat pump (not shown), which includes an outdoor coil and a compressor. The direct expansion coil 110 is made up of one or more individual coils that circulate a refrigerant. In operation, indoor air is passed over the direct expansion coil 110, allowing heat to be exchanged between the refrigerant circulating through the direct expansion coil 110 and the indoor air passing over the direct expansion coil 110.

The coil assembly 100 is configured such that the refrigerant changes its state between liquid and vapor during the air-conditioning cycle that passes the refrigerant through the direct expansion coil 110 and the reheat coil 115.

In the embodiment shown in FIG. 1, the direct expansion coil 110 is an A-coil with the base of the A-coil facing the first vertical drain pan 150 and the peak of the A-coil facing the second vertical drain pan 160. However, alternate embodiments could use a different type of coil such as an N-coil, an M-coil, or a slab coil.

In a heating mode, the refrigerant will be at a higher temperature than the indoor air, allowing heat to transfer from the refrigerant to the indoor air, heating the indoor air. In a cooling mode, the refrigerant will be at a lower temperature than the indoor air, allowing heat to transfer from the indoor air to the refrigerant, cooling the indoor air.

Furthermore, during a cooling mode, the refrigerant circulating through the direct expansion coil 110 can be set at a temperature low enough that it will cause moisture to condense out of the indoor air onto the direct expansion coil 110, thus dehumidifying the air.

The reheat coil 115 is located after the direct expansion coil 110 in the flow of air through the coil assembly 100 and operates to heat air that has been over-cooled by the direct expansion coil 110 to remove moisture from the air.

Although the direct expansion coil 110 and the reheat coil 115 operate on the indoor air, raising or lowering the temperature of the indoor air, the indoor air can be referred to in different ways at different stages of the process for clarity of disclosure. For example, during a cooling mode, when indoor air is first drawn into the coil assembly 100, it can be considered supply air. After the supply air has been cooled by the direct expansion coil 110 and moisture has been removed from the supply air, it can be considered dehumidified air, which is provided to the reheat coil 115 for heating. After the dehumidified air is heated by the reheat coil 115 to a desired temperature, it can be considered output air, which is provided back to an indoor space to mix with the indoor air to bring its temperature to a desired setpoint temperature.

The first horizontal drain pan 120 is located on a first side of the direct expansion coil 110 when the coil assembly 100 is in the first orientation. As a result, no condensed water will drip from the direct expansion coil 110 into the first horizontal drain pan 120 during a cooling operation when the coil assembly 100 is in the first orientation.

The first horizontal drain pan 120 is defined by a plurality of first horizontal drain pan walls and a first horizontal drain pan bottom that form a drain area that faces the direct expansion coil 110. The first shelf 130 is arranged between two of the first horizontal drain pan walls such that it forms the first recess 140 next to the drain area. This first recess 140 is configured such that it can receive and hold one end of the reheat coil 115.

The one or more first horizontal drain pan drains 170 are formed in one or more of the plurality of first horizontal drain pan walls and operate to provide a way for water to exit the first horizontal drain pan 120 when the coil assembly 100 is in an orientation in which water drips into the first horizontal drain pan 120 from the direct expansion coil 110.

In the embodiment disclosed in FIG. 1, two first horizontal drain pan drains 170 are provided in the first horizontal drain pan 120. One of these two first horizontal drain pan drains 170 is provided as a primary drain, and the other is provided as a secondary drain should the first drain get clogged. The secondary drain can be located higher than the primary drain when the coil assembly 100 is in an orientation in which water drips into the first horizontal drain pan 120 from the direct expansion coil 110. This allows water to drain through the primary drain first if there is no clog in the primary drain. Only when the primary drain is clogged, and water rises to the level of the secondary drain will water flow out of the secondary drain.

The second horizontal drain pan 125 is located on a second side of the direct expansion coil 110 opposite the first horizontal drain pan 120 when the coil assembly 100 is in the first orientation. As a result, no condensed water will drip from the direct expansion coil 110 into the second horizontal drain pan 125 during a cooling operation when the coil assembly 100 is in the first orientation.

The second horizontal drain pan 125 is defined by a plurality of second horizontal drain pan walls and a second horizontal drain pan bottom that form a drain area that faces the direct expansion coil 110. The second shelf 135 is arranged between two of the second horizontal drain pan walls such that it forms the second recess 145 adjacent to the drain area. This second recess 145 is configured such that it can receive and hold another end of the reheat coil 115.

The one or more second horizontal drain pan drains 175 are formed in one or more of the plurality of second horizontal drain pan walls and operate to provide a way for water to exit the second horizontal drain pan 125 when the coil assembly 100 is in an orientation in which water drips into the second horizontal drain pan 125 from the direct expansion coil 110.

In the embodiment disclosed in FIG. 1, two second horizontal drain pan drains 175 are provided in the second horizontal drain pan 125. One of the two second horizontal drain pan drains 175 is provided as a primary drain, and the other is provided as a secondary drain should the first drain get clogged. The secondary drain can be located higher than the primary drain when the coil assembly 100 is in an orientation in which water drips into the second horizontal drain pan 125 from the direct expansion coil 110. This allows water to drain through the primary drain first if there is no clog in the primary drain. Only when the primary drain is clogged and water rises to the level of the secondary drain will water flow out of the secondary drain.

The first vertical drain pan 150 is located under the direct expansion coil 110 and the reheat coil 115 when the coil assembly 100 is in the first orientation. As a result, condensed water will drip from the direct expansion coil 110 into the first vertical drain pan 150 during a cooling operation when the coil assembly 100 is in the first orientation.

The first vertical drain pan 150 is defined by a plurality of first vertical drain pan walls, the plurality of slanted drain pan walls 155, and a first vertical drain pan bottom that together form a drain area that faces the direct expansion coil 110. The plurality of slanted drain pan walls 155 define the opening 158 in the center of the first vertical drain pan 150. This opening 158 allows air to be drawn through it and passed to the direct expansion coil 110 for conditioning. The first vertical drain pan bottom is formed between the slanted drain pan walls 155 and the plurality of first vertical drain pan walls. The degree of slanting of the plurality of slanted drain pan walls 155 can be set to correspond with the slant of the sides of the direct expansion coil 110. This allows the plurality of slanted drain pan walls 155 to be formed relatively close to inside surfaces of the direct expansion coil 110, maximizing the size of the opening 158 in the first vertical drain pan 150 and so the amount of air that can pass through it.

The one or more first vertical drain pan drains 180 are formed in one or more of the plurality of first vertical drain pan walls and operate to provide a way for water to exit the first vertical drain pan 150 when the coil assembly 100 is in an orientation in which water drips into the first vertical drain pan 150 from the direct expansion coil 110.

One of these two first vertical drain pan drains 180 is provided as a primary drain, and the other is provided as a secondary drain should the first drain get clogged. The secondary drain can be located higher than the primary drain when the coil assembly 100 is in the first orientation in which water drips into the first vertical drain pan 150 from the direct expansion coil 110. This allows water to drain through the primary drain first if there is no clog in the primary drain. Only when the primary drain is clogged, and water rises to the level of the secondary drain will water flow out of the secondary drain.

The second vertical drain pan 160 is located between the direct expansion coil 110 and the reheat coil 115, opposite a top of the direct expansion coil 110.

The second vertical drain pan 160 is defined by a plurality of second vertical drain pan walls and a second vertical drain pan bottom that together form a drain area that faces the direct expansion coil 110. In an embodiment in which the direct expansion coil 110 is an A-coil, the second vertical drain pan 160 can be narrower than the first vertical drain pan 150 because the second vertical drain pan 160 faces the peak of the A-coil and the first vertical drain pan 150 faces the base of the direct expansion coil 110.

The one or more second vertical drain pan drains 185 are formed in one of the plurality of second vertical drain pan walls and operate to provide a means for water to exit the second vertical drain pan 160 when the coil assembly 100 is in an orientation in which water fall into or is blown into the second vertical drain pan 160 from the direct expansion coil 110.

The support beam 190 secures the second vertical drain pan 160 to one of the first and second horizontal drain pans 120, 125. In the embodiment of FIG. 1, the support beam 190 is secured between the second vertical drain pan 160 and the first horizontal drain pan 120. However, in alternate embodiments, the support beam 190 could be secured between the second vertical drain pan 160 and the second horizontal drain pan 125. Other alternate embodiments could include multiple support beams, one securing the second vertical drain pan 160 to the first horizontal drain pan 120 and another securing the second vertical drain pan 160 to six the second horizontal drain panel 125.

The air conditioner casing 195 is a housing of a larger air conditioner that contains the coil assembly 100.

The coil assembly 100 is formed by attaching a first side of the direct expansion coil 110 to the first vertical drain pan 150 and securing the first and second horizontal drain pans 120, 125 to the sides of the first vertical drain pan 150. In this way, the first vertical drain pan 150 forms a bottom of the coil assembly 100 and the first and second horizontal drain pans 120, 125 form the sides of coil assembly 100. No further supporting structure is necessary. In addition, the reheat coil 115 is placed between the first and second horizontal drain pans 120, 125 such that one end of the reheat coil 115 is placed in the first recess 140 in the first horizontal drain pan 120 and the other end of the reheat coil 115 is placed in the second recess 145 in the second horizontal drain pan 125. In this way, the reheat coil 115 is secured between the first and second horizontal drain pans 120, 125 without the need for any additional mechanisms to secure the reheat coil 115.

Although not shown in FIG. 1, it's the coil assembly 100 may include connection mechanisms that operate to secure the direct expansion coil 110 to the first vertical drain pan 150, to connect the first and second horizontal drain pans 120, 125 to the first vertical drain pan 150, and to connect the support beam 190 to the second vertical drain pan 160 and one of the first and second horizontal drain pans 120, 125. These connection mechanisms could include bolts, clamps, or any suitable structure to connect to these elements. In the alternative, some or all of the direct expansion coil 110, the first and second horizontal drain pans 120, 125, the first vertical drain pan 150, the second vertical drain pan 160, and the support beam 190 can be configured in such a manner that they can be secured to each other, e.g., by having locking structures built into these elements.

In the embodiment of FIG. 1, no additional connection mechanisms are required to hold the reheat coil 115 in place. By fixing the first and second horizontal drain pans 120, 125 in place and inserting ends of the reheat coil 115 into the recesses 140, 145 of the first and second horizontal drain pans 120, 125, respectively, the reheat coil 115 can be secured without any additional connection mechanisms. However, nothing in this disclosure should preclude embodiments in which additional connection mechanisms are provided.

By securing the direct expansion coil 110 and the first and second horizontal drain pans 120, 125 to the first vertical drain pan 150, securing the second vertical drain pan 160 to one or both of the horizontal drain pans 120, 125, and securing the reheat coil 115 between the first and second horizontal drain pans 120, 125, the disclosed coil assembly 100 is more compact compared to designs in which extra structure is required to secure these elements together.

Furthermore, by having multiple different drain pans 120, 125, 150, the disclosed coil assembly 100 can be used in a greater number of orientations. Specifically, the coil assembly 100 can be used in the first orientation in which the coil assembly 110 is located above the first vertical drain pan 150, in a second orientation in which the coil assembly 100 is located above the first horizontal drain pan 120, or in a third orientation in which the coil assembly 100 is located above the second horizontal drain pan 125. This allows a single design for the coil assembly 100 to be used in air conditioners that are placed such that the coil assembly 100 will be in any of these three configurations. This allows for greater flexibility in how an air conditioner using the disclosed coil assembly 100 can be installed.

In the embodiment of FIG. 1, the first and second horizontal drain pans 120, 125 are arranged such that their bottom surfaces are substantially parallel to each other; the first and second vertical drain pans 150, 160 are arranged such that their bottom surfaces are substantially parallel to each other; and the first and second horizontal drain pans 120, 125 are arranged such that their bottom surfaces are substantially perpendicular to bottom surfaces of the first and second vertical drain pans 151, 160. However, this is by way of example only.

In general, the possible arrangements of the drain pans 120, 125, 150, 160 are made to secure the direct expansion coil 110 and the reheat coil 115 without the need for additional structure, and to provide at least three different orientations in which the coil assembly 100 can be arranged and for which at least one of the drain pans 120, 125, 150, 160 will serve to catch water that condenses on the direct expansion coil 110 during a dehumidifying operation. Any arrangement of the drain pans 120, 125, 150, 160 that achieves these goals is within the scope of this disclosure.

In addition, although the embodiment of FIG. 1 shows the first and second horizontal drain pans 120, 125 being attached to the outside of the first vertical drain pan 150, this is by way of example only. In alternate embodiments the first and second horizontal drain pans 120, 125 could be attached in a similar position but on the inside of the first vertical drain pan 150. In such an embodiment the direct expansion coil 110 could be attached at its two bottom ends to respective ones of the first and second horizontal drain pans 120, 125 and the assembly of direct expansion coil 110 and first and second horizontal drain pans 120, 125 inserted into and attached to the first vertical drain pan 150.

Figure 2:
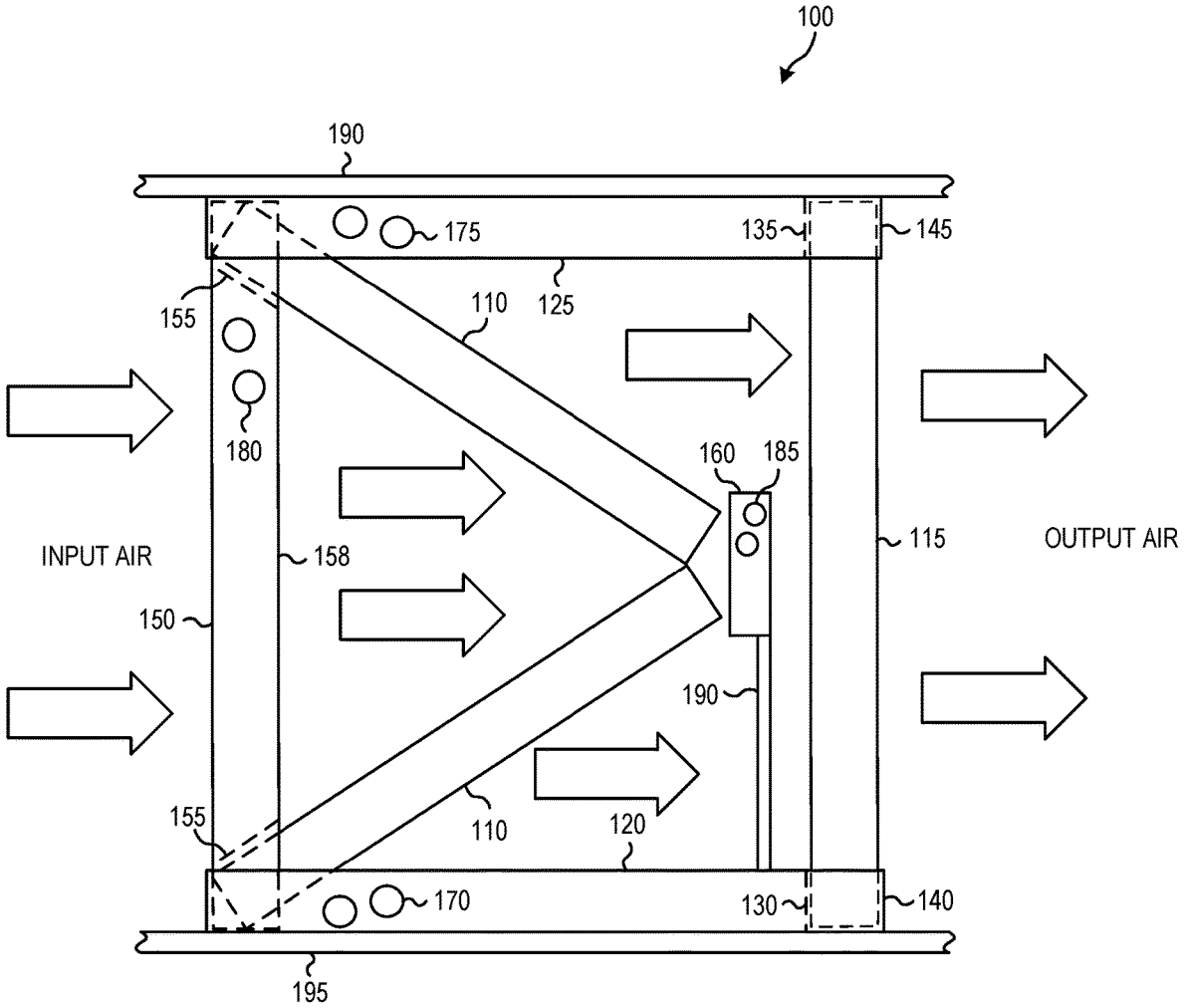
FIG. 2 is a diagram of the coil assembly of FIG. 1 in a second orientation according to disclosed embodiments.

FIG. 2 is a diagram of the coil assembly of FIG. 1 in a second orientation according to disclosed embodiments. In the second orientation, the direct expansion coil 110 and the reheat coil 115 are both arranged over the first horizontal drain pan 120. For purposes of this disclosure, this second orientation will be considered a first horizontal orientation.

Figure 3:
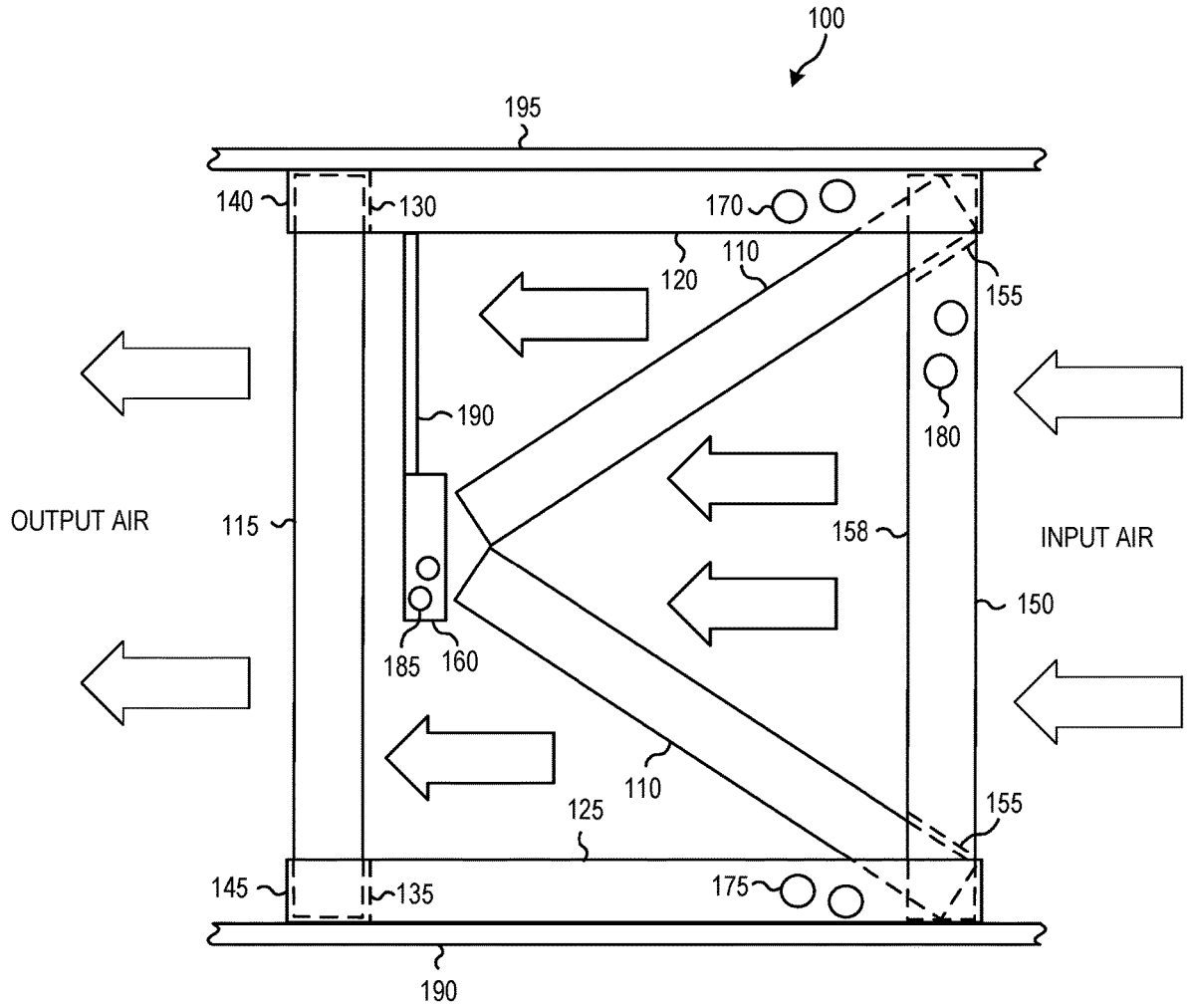
FIG. 3 is a diagram of the coil assembly of FIG. 1 in a third orientation according to disclosed embodiments.

FIG. 3 is a diagram of the coil assembly of FIG. 1 in a third orientation according to disclosed embodiments. In the third orientation, the direct expansion coil 110 and the reheat coil 115 are both arranged over the second horizontal drain pan 125. The elements in FIG. 3 are the same as those in FIG. 1 and so their description will not be repeated. For purposes of this disclosure, this third orientation will be considered a second horizontal orientation.

Although not shown in one of the drawings, some down flow arrangements of the coil assembly could be used in a fourth orientation in which the direct expansion coil 110 is arranged above the second vertical drain pan 160. Such an orientation would have condensed water from the direct expansion coil 110 drain into the second vertical drain pan 185. For purposes of this disclosure, this third orientation will be considered a second vertical orientation.

Figure 4:
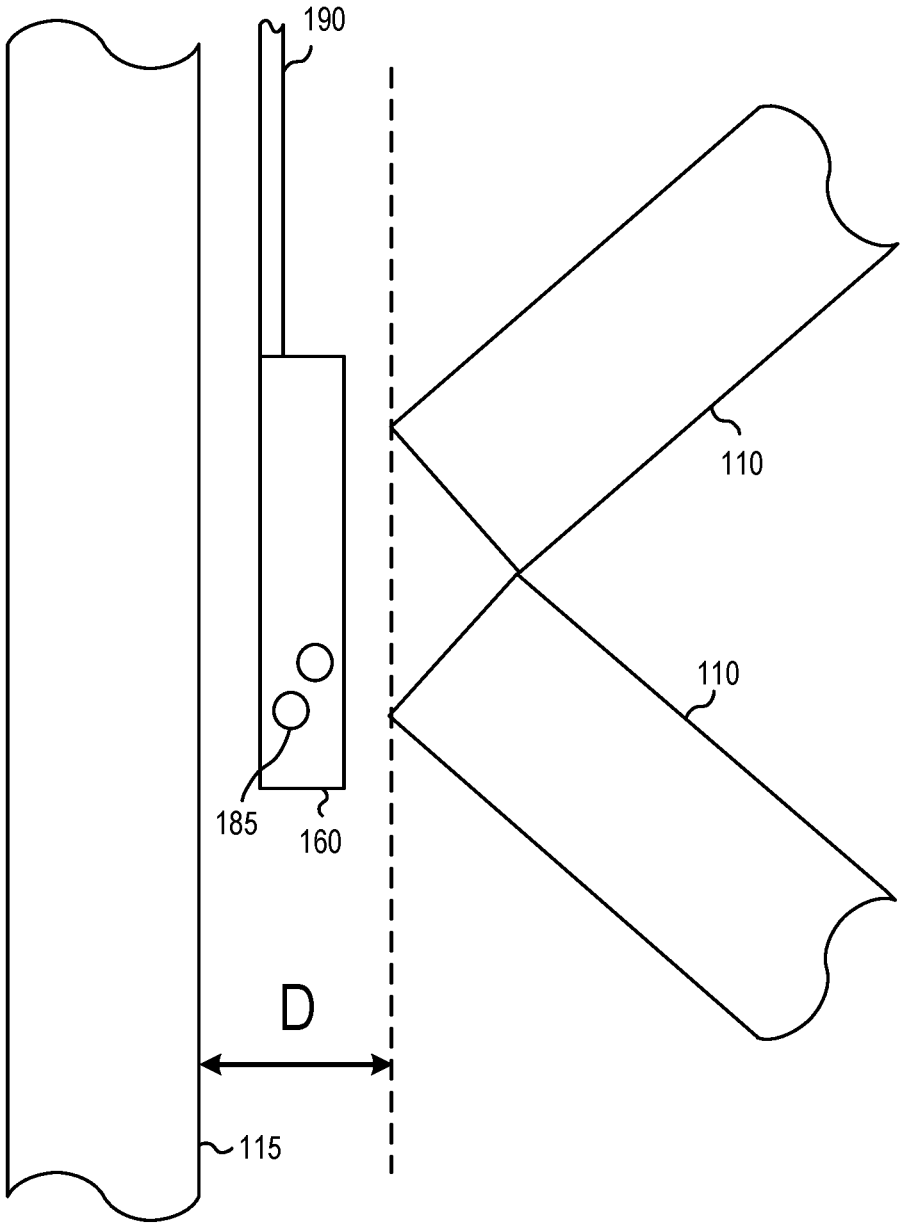
FIG. 4 is a close-up diagram of a portion of the coil assembly of FIG. 1 showing a distance between a direct expansion coil and a reheat coil according to disclosed embodiments.

FIG. 4 is a close-up diagram of a portion of the coil assembly of FIG. 1 showing a distance between a direct expansion coil and a reheat coil according to disclosed embodiments. As shown in FIG. 4, the direct expansion coil 110 and the reheat coil 115 are arranged such that there is a distance D between the two elements.

As shown in the embodiment of FIG. 1, the distance D will be sufficient to allow the second vertical drain pan 160 to be arranged between the direct expansion coil 110 and the reheat coil 115. In various embodiments this distance D can vary, but in some disclosed embodiments it will be between 1 inch and 6 inches.

Horizontal Drain Pan

Figure 5:
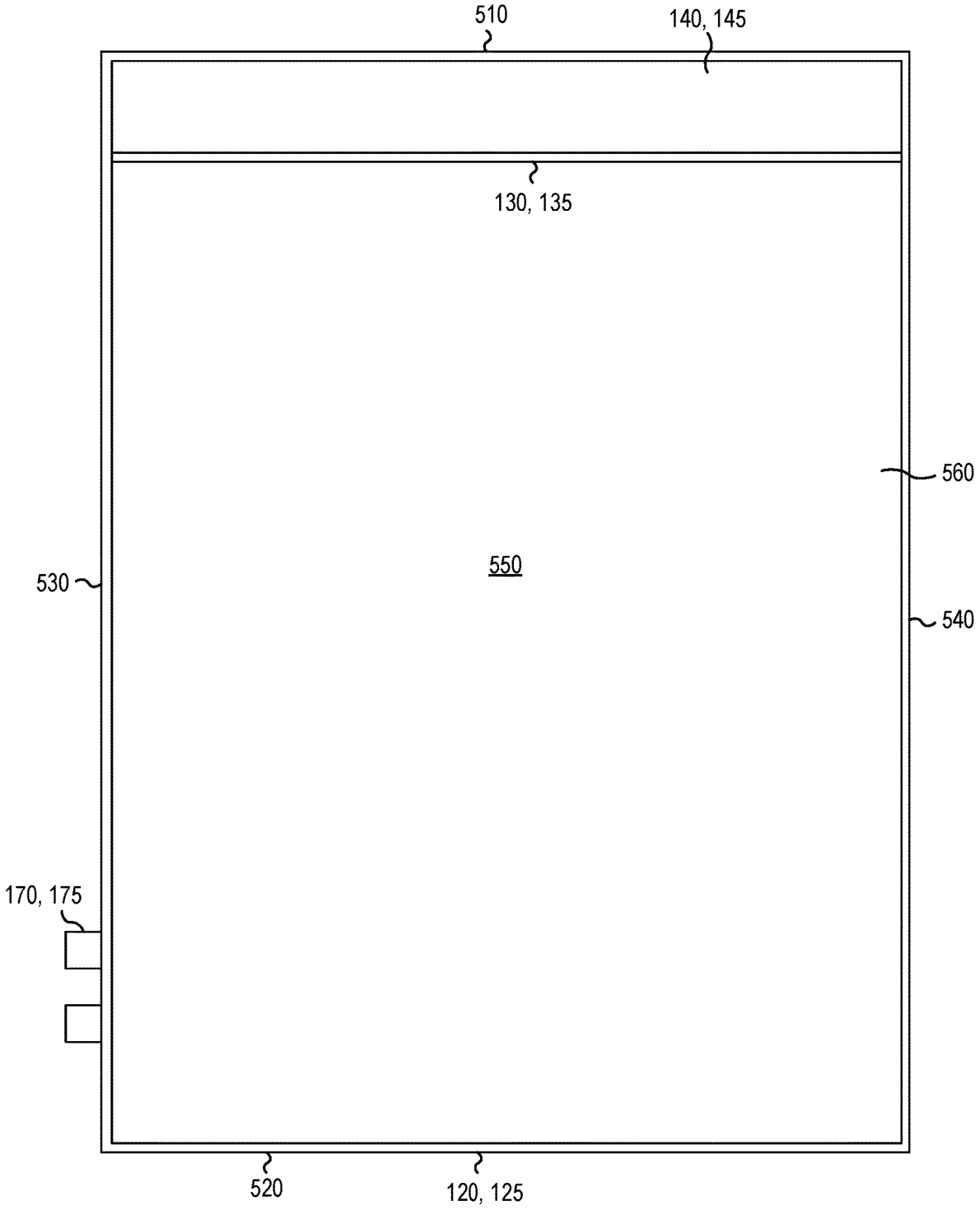
FIG. 5 is an overhead view of a horizontal drain pan for a coil assembly according to disclosed embodiments.
Figure 6:
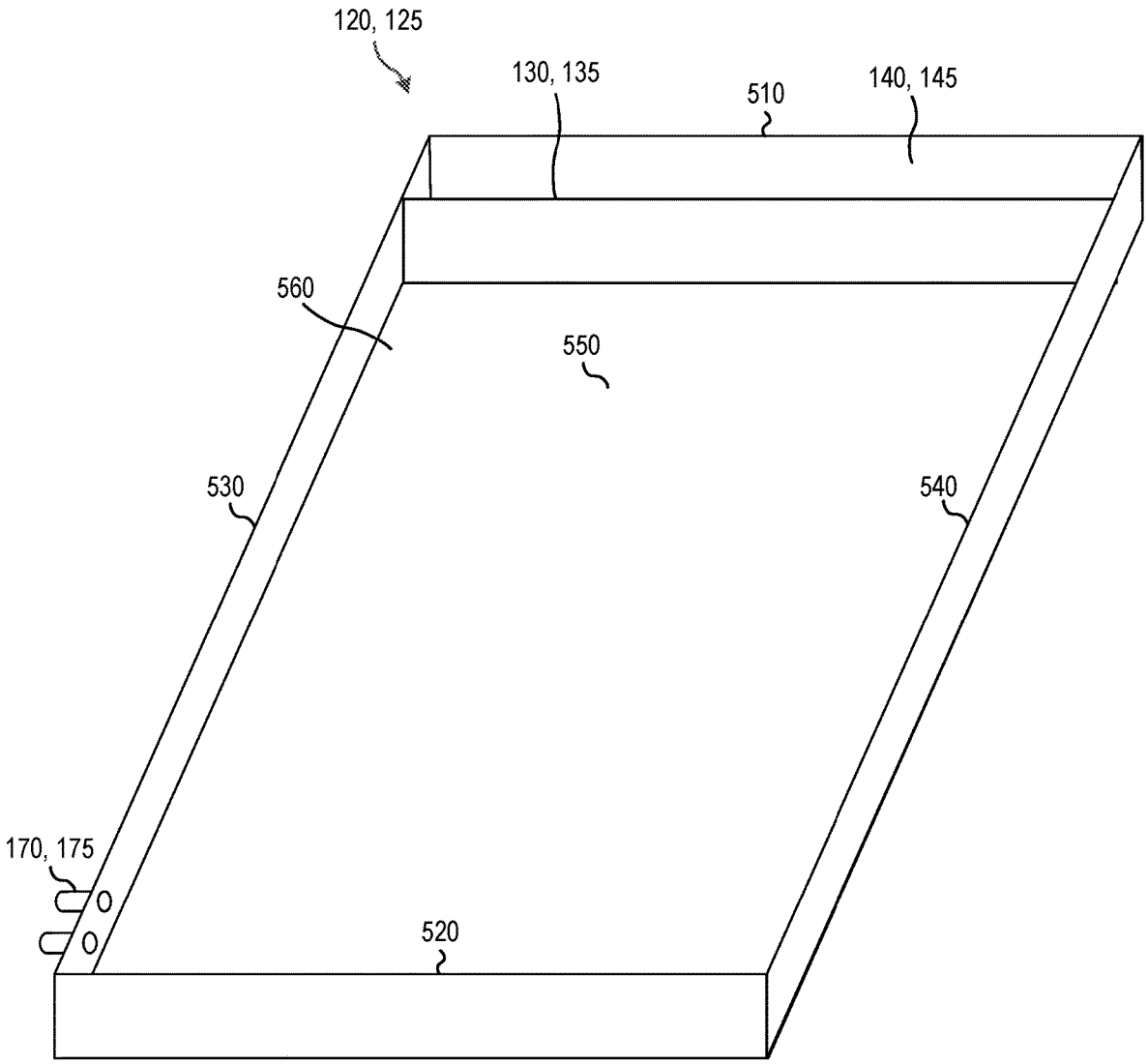
FIG. 6 is a perspective view of the horizontal drain pan of FIG. 5 according to disclosed embodiments.

FIG. 5 is an overhead view of the horizontal drain pans 120, 125 for a coil assembly 100 according to disclosed embodiments. FIG. 6 is a perspective view of the horizontal drain pans 120, 125 of FIG. 5 according to disclosed embodiments.

As shown in FIGS. 5 and 6, the horizontal drain pan 120, 125 includes a first horizontal drain pan wall 510, a second horizontal drain pan wall 520, a third horizontal drain pan wall 530, a fourth horizontal drain pan wall 540, a horizontal drain pan bottom 550, a shelf 130, 135, and one or more horizontal drain pan drains 170, 175.

The first, second, third, and fourth horizontal drain pan walls 510-540 define the outer boundaries of the horizontal drain pan 120, 125 and along with the horizontal drain pan bottom 550 an area for catching moisture that drops from the direct expansion coil 110 in a configuration in which the corresponding horizontal drain pan 120, 125 is beneath the direct expansion coil 110.

The shelf 130, 135 is formed between the third and fourth horizontal drain pan walls 530, 540 and is configured to break the area between the first, second, third, and fourth horizontal's drain pan walls 510-540 into a recess 140, 145 and a drain area 560. The recess 140, 145 is configured to hold one end of the reheat coil 115, and the drain area 560 is configured to contain water dripping from the direct expansion coil 110 when the coil assembly 100 is in a configuration such that the horizontal drain pan 120, 125 is beneath the direct expansion coil 110.

Given the positioning of the direct expansion coil 110 and the reheat coil 115 and their separation, the coil assembly 100 is configured such that the direct expansion coil 110 is only over the drain area 560 and not over the recess 140, 145 when the coil assembly 100 is in a configuration such that the horizontal drain pan 120, 125 is beneath the direct expansion coil 110. As a result, when water drips from the direct expansion coil 110 during a cooling/dehumidification process, it will drain into area 560 of the respective horizontal drain pan 120, 125.

Although the embodiments of FIGS. 1-6 show the first and second horizontal drain pans 120, 125 as having a flat horizontal drain pan bottom 550, this is by way of example only. In alternate embodiments the horizontal drain pan bottom 550 can include slanted portions, channels, or other arrangements to help control the movement of fluid in the horizontal drain pans 120, 125 and to the horizontal drain pan drain 170, 175.

In various embodiments the first and second horizontal drain pans 120, 125 can be identical, can be mirror images of each other, or can have slightly different configurations, e.g., varying in size, position of horizontal drain pan drains 170, 175, etc.

First Vertical Drain Pan

Figure 7:
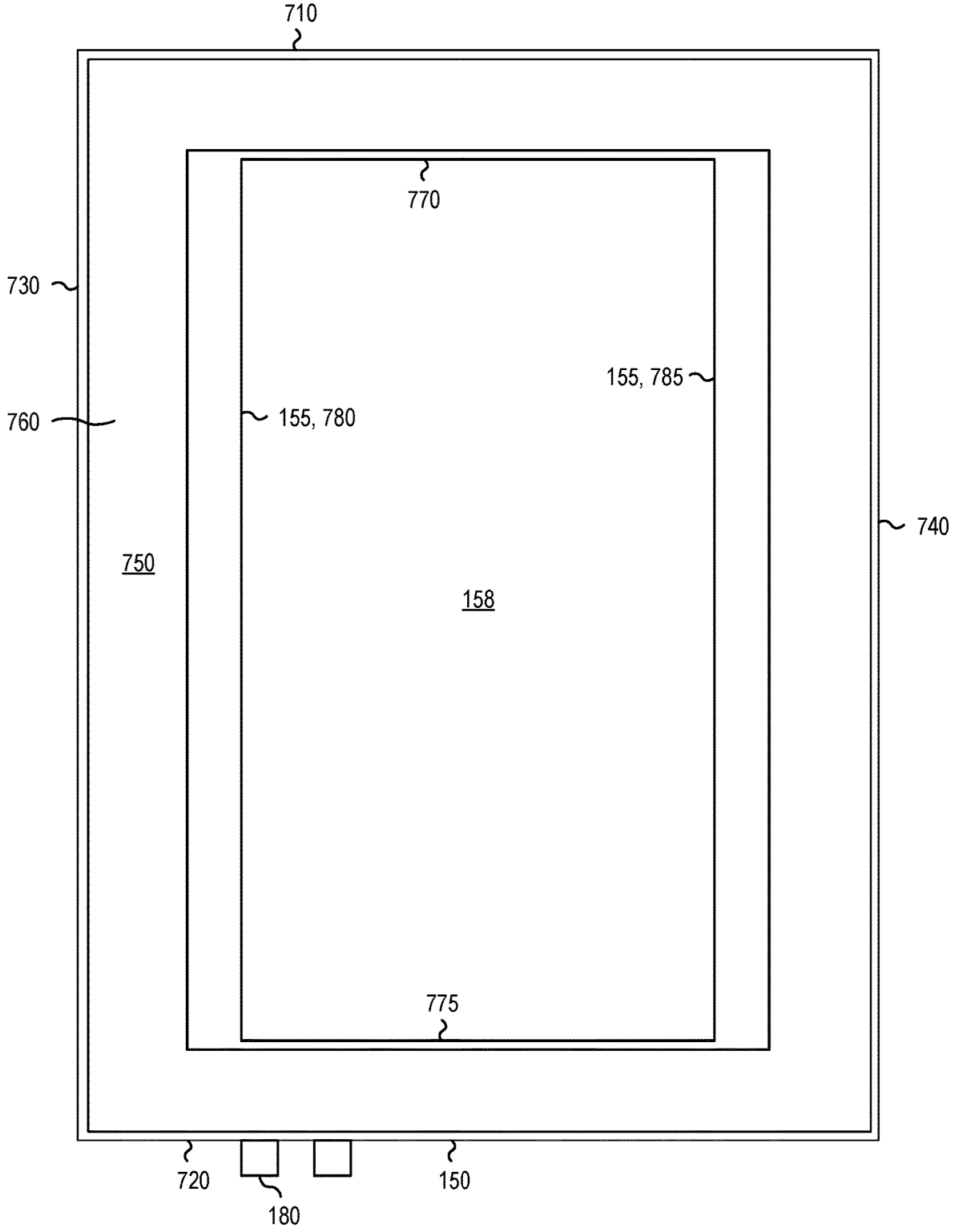
FIG. 7 is an overhead view of a first vertical drain pan for a coil assembly according to disclosed embodiments.
Figure 8:
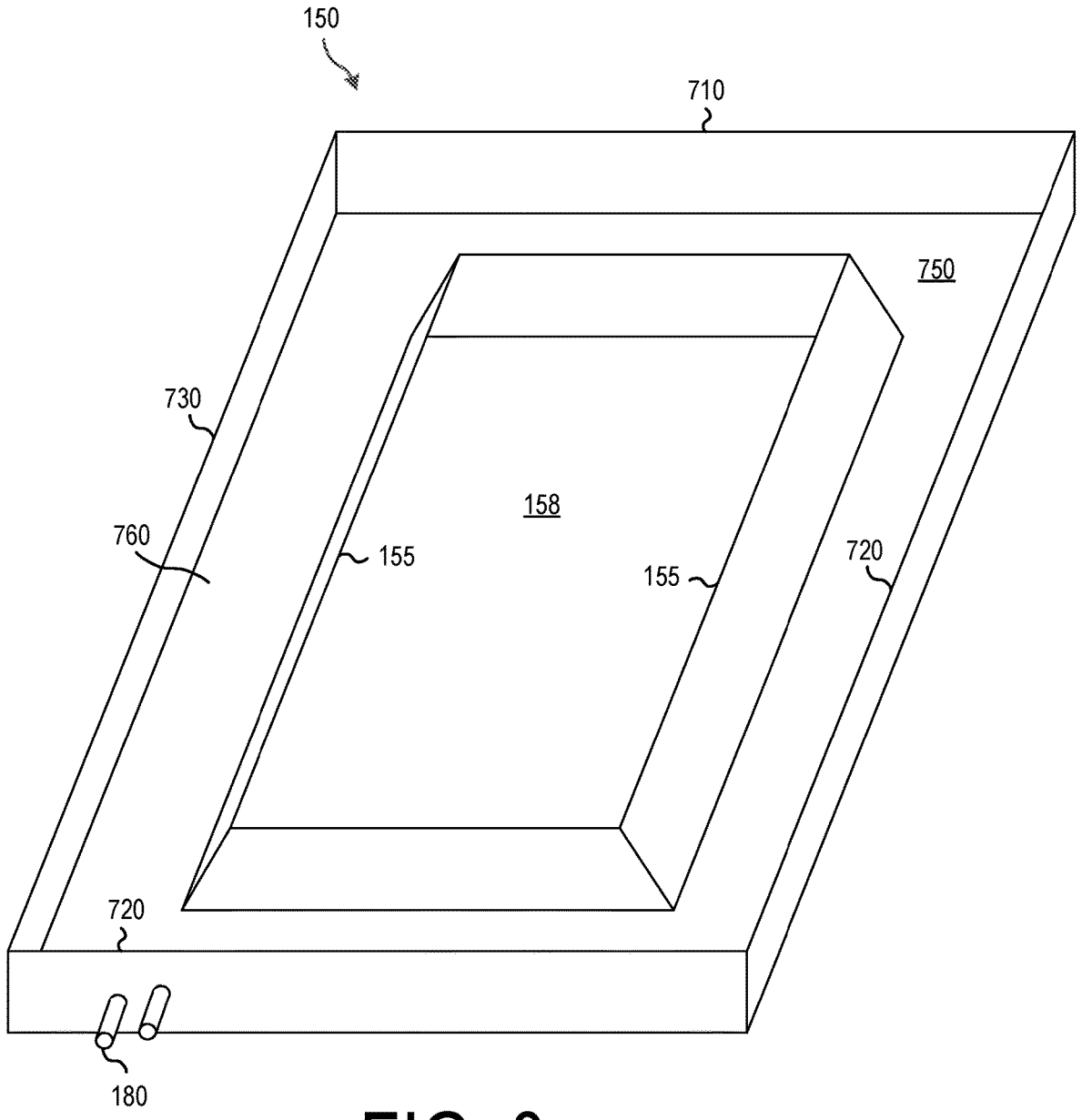
FIG. 8 is a perspective view of the first vertical drain pan of FIG. 7 according to disclosed embodiments.

FIG. 7 is an overhead view of the first vertical drain pan 150 for a coil assembly 100 according to disclosed embodiments. FIG. 8 is a perspective view of the first vertical drain pan 150 of FIG. 7 according to disclosed embodiments.

As shown in FIGS. 7 and 8, the first vertical drain pan 150 includes a first vertical drain pan outer wall 710, a second vertical drain pan outer wall 720, a third vertical drain pan outer wall 730, a fourth vertical drain pan outer wall 740, a first vertical drain pan inner wall 770, a second vertical drain pan inner wall 775, a third vertical drain pan inner wall 780, a fourth vertical drain pan inner wall 785, a vertical drain pan bottom 750, one or more first vertical drain pan drains 180.

The first, second, third, and fourth vertical drain pan outer walls 710-740 define the outer boundaries of the first vertical drain pan 150. The first, second, third, and fourth vertical drain pan inner walls 770-785 define the outer boundaries of the opening 158 in the first vertical drain pan 150. The first, second, third, and fourth vertical drain pan outer walls 710-740, the first, second, third, and fourth vertical drain pan inner walls 770-785, and the vertical drain pan bottom 750 together define a drain area 760 for catching moisture that drops from the direct expansion coil 110 in the first configuration in which the first vertical drain pan 150 is beneath the direct expansion coil 110.

The third and fourth vertical drain pan inner walls 780, 785 correspond to the slanted drain pan walls 155 of FIG. 1. The slanted drain pan walls 155 (780, 785) in the embodiment of FIG. 1 are formed at an angle that generally corresponds to the angle of the sides of the direct expansion coil 110. This allows the slanted drain pan walls 155 (780, 785) to be close to the slanting sides of the direct expansion coil 110 and maximizes the size of the opening 158 in the first vertical drain pan 150 while preventing moisture from dripping into the opening 158 as it falls from the direct expansion coil 110.

Although the embodiments of FIGS. 1-4, 7, and 8 show the first vertical drain pan 150 as having a flat horizontal drain pan bottom 750, this is by way of example only. In alternate embodiments the vertical drain pan bottom 750 can include slanted portions, channels, or other arrangements to help control the movement of fluid in the first vertical drain pan 150 and to the one or more first vertical drain pan drains 180.

Second Vertical Drain Pan

The second vertical drain pan 160 includes a plurality of vertical drain pan walls, a vertical drain pan bottom, and one or more second vertical drain pan drains 185. The vertical drain pan outer walls and the vertical drain pan bottom define a drain area for catching moisture that is blown from the direct expansion coil 110 in various configurations.

The second vertical drain pan 160 is located adjacent to the tip of the direct expansion coil 110 with its drain area facing the direct expansion coil 110. Since air is being blown through the direct expansion coil 110 from the direction of the first vertical drain pan 150 to the direction of the second vertical drain pan 160, this flow of air may carry with it some of the moisture condensed onto the direct expansion coil 110 during a cooling/dehumidification operation.

However, given the properties of the condensed water and the arrangement of the direct expansion coil 110, the water will generally flow to the downwind end of the direct expansion coil 110 and the blown off there. As a result, most of the water can be caught if the second vertical drain pan 160 is arranged opposite the downwind end of the direct expansion coil 110. Since the downwind end of the direct expansion coil 110 is smaller than the upwind end of the direct expansion coil 110, the second vertical drain pan 160 can be narrower than the first vertical drain pan 150. This further allows that the second vertical drain pan 160 will not block the flow of air from the direct expansion coil 110 to the reheat coil 115. Although the second vertical drain pan 160 is between the direct expansion coil 110 and the reheat coil 115, it is smaller than the air passage, allowing air to flow around it.

The second vertical drain pan 160 is arranged such that moisture blown from the direct expansion coil 110 will be caught in the drain area of the second vertical drain pan 160 and be routed to the one or more second vertical drain pan drains 185, where they will be routed to an exterior drain.

Absent the presence of the second vertical drain pan 160, the moisture blown from the direct expansion coil 110 could be blown onto the reheat coil 115, where it could be evaporated by the heat of the reheat coil 115 and returned to the output air being supplied to the indoor space. Such an occurrence would reduce the effectiveness of the original cooling/dehumidification operation by returning moisture to the air passing through the coil assembly 100 after that moisture has been extracted by the direct expansion coil 110 during the cooling/dehumidification process.

The second vertical drain pan 160 may have a flat horizontal drain pan bottom or it can include slanted portions, channels, or other arrangements to help control the movement of fluid in the second vertical drain pan 160 and to the one or more second vertical drain pan drains 185.

Side View of Coil Assembly

Figure 9:
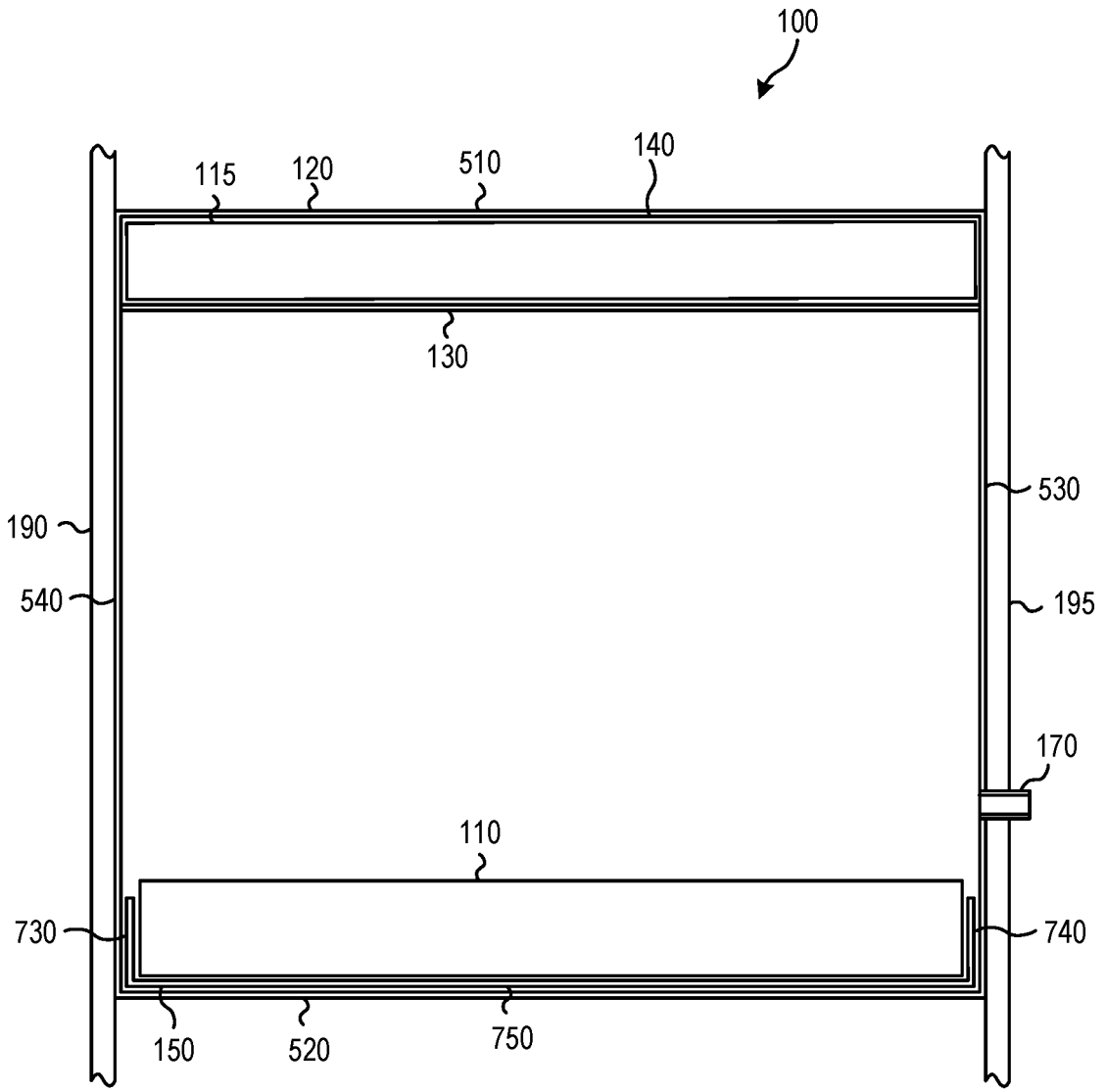
FIG. 9 is a cross-sectional view of the coil assembly of FIG. 1 along line IX-IX' according to disclosed embodiments.

FIG. 9 is a cross-sectional view of the coil assembly 100 of FIG. 1 along line IX-IX' according to disclosed embodiments. Specifically, FIG. 9 shows a cross-section of the coil assembly 100 at the first horizontal drain pan 120.

The upper portion of FIG. 9 shows how one end of the reheat coil 115 is inserted in the recess 140 formed by the first horizontal drain pan wall 510, the shelf 130, a portion of the third horizontal drain pan wall 530, and a portion of the fourth horizontal drain pan wall 540.

The lower portion of FIG. 9 shows how the lower end of the direct expansion coil 110 is inserted into the first vertical drain pan 150. In some embodiments the direct expansion coil 110 can rest directly on the first vertical drain pan bottom 750 or be sealed to the pan to minimuze airflow passing around it. It is possible, however, that other embodiments could secure the direct expansion coil 110 such that it is held above the first vertical drain pan bottom 750.

The right portion of FIG. 9 shows how a first horizontal drain pan drain 170 extends out of the first horizontal drain pan 120 and through the air conditioner casing 195. Although not shown, there can be further connections beyond the first horizontal drain pan drain 170, such as pipes, tubing, or the like, to route moisture from the first horizontal drain pan drain 170 to an external drain or drainage area.

Furthermore, although the cross-sectional view of FIG. 9 does not show a cross-section of the second horizontal drain pan drains 175 or the first vertical drain pan drains 170, these drains 175, 180 will be similarly routed through the air conditioner casing 195 to an external drain or drainage area.

Likewise, the second vertical drain pan drains 185 will be routed from the second vertical drain pan 160 to an external drain or drainage area. This could be a direct routing by having the second vertical drain pan drain 185 channel water directly from the second vertical drain pan 160, through the air conditioner casing 195 to the external drain or drainage area. In the alternative, it could be an indirect routing in which water from the second vertical drain pan drain 185 is routed to one of the other drain pans 120, 125, 150 from which it is then routed to the external drain or drainage area.

Air Conditioner Including a Coil Assembly

Figure 10:
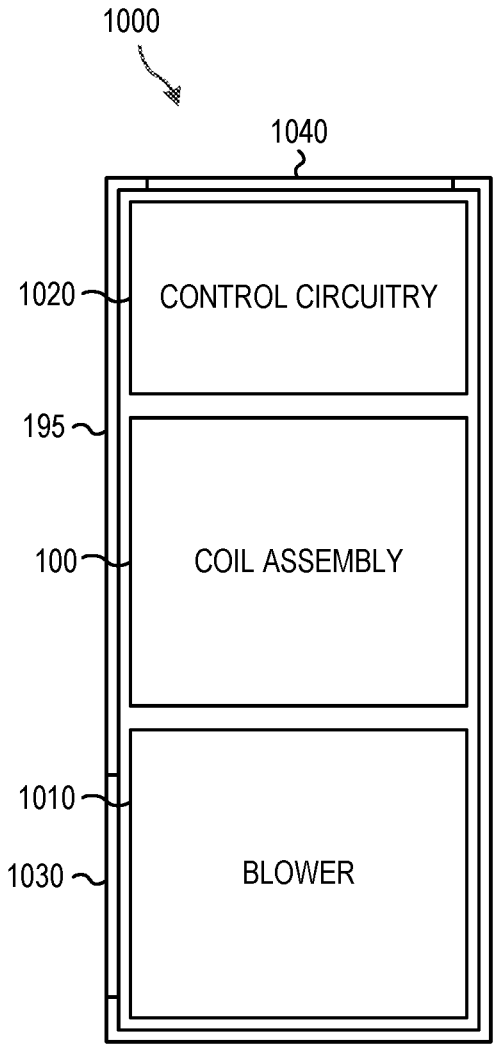
FIG. 10 is a diagram of an air conditioner including the coil assembly of FIG. 1 according to disclosed embodiments.
Figure 11:
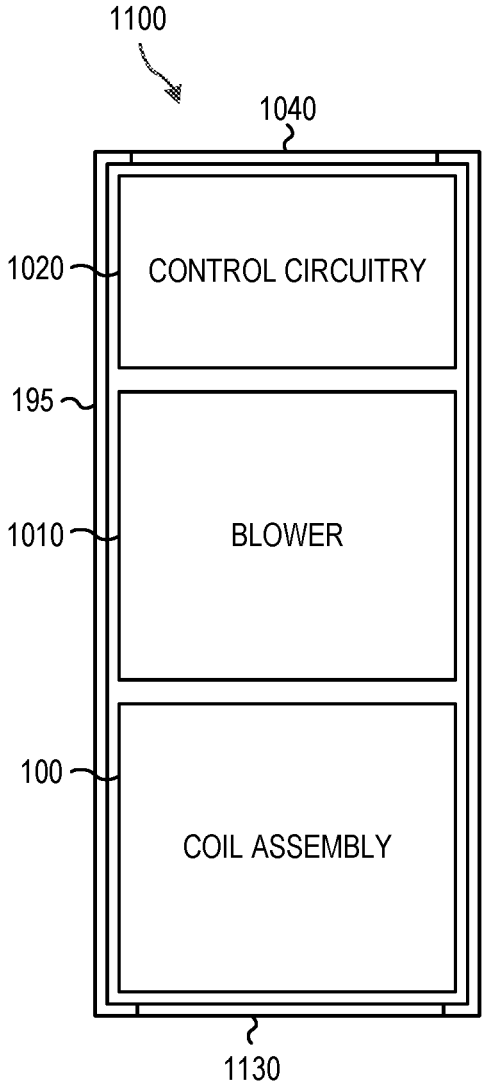
FIG. 11 is a diagram of an air conditioner including the coil assembly of FIG. 1 according to alternate disclosed embodiments.

FIG. 10 is a diagram of an air conditioner 1000 including the coil assembly 100 of FIG. 1 according to disclosed embodiments. FIG. 11 is a diagram of an air conditioner 1100 including the coil assembly 100 of FIG. 1 according to alternate disclosed embodiments.

As shown in FIGS. 10 and 11, the air conditioners 1000, 1100 each include a coil assembly 100, a blower 1010, and control circuitry 1020. These elements are arranged in an air conditioner casing 195 that includes an input vent 1030, 1130 and an output vent 1040.

The coil assembly 100 is configured as noted above in FIGS. 1-9 and its description will not be repeated.

The blower 1010 is a fan configured to circulate air through the air conditioner 100, 1100. In one embodiment it can be a centrifugal blower fan, though this is by way of example only. Any suitable air conditioner fan can be used. The blower 1010 operates to circulate air through the air conditioner casing 195, passing it through the coil assembly 100 and past the control circuitry 1020.

The control circuitry 1020 is electronic circuitry configured to control the operation of the coil assembly 100 and the blower 1010, as well as any other elements of the air conditioner 1000, 1100 that require control signals. Although the control circuitry 1020 is shown as a box in the air conditioners 1000, 1100, the control circuitry 1020 does not fill the entirety of the space within the air conditioner casing 195 where it appears. Rather, the control circuitry is located at a particular place inside the air conditioner casing 195 but includes or is placed next to an air passage that allows air to pass easily from one side of the control circuitry 1020 to the other.

In the embodiment of FIG. 10, the air conditioner 1000 is configured with the blower 1010 at a first end of the air conditioner 1000 (the bottom of FIG. 10), the control circuitry 1020 at a second end of the air conditioner 1000 (the top of FIG. 10), and the coil assembly 100 and between the blower 1010 and the control circuitry 1020.

In the embodiment of FIG. 10, the blower 1010 draws supply air in through the input vent 1030 from an indoor space and blows that supply air through the coil assembly 100, past the control circuitry 1020, and out the output vent 1040.

In the embodiment of FIG. 11, the air conditioner 1100 is configured with the coil assembly 100 at a first end of the air conditioner 1100 (the bottom of FIG. 11), the control circuitry 1020 at a second end of the air conditioner 1100 (the top of FIG. 11), and the blower 1010 between the coil assembly 100 and the control circuitry 1020.

In the embodiment of FIG. 11, the blower 1010 draws supply air in through the input vent 1030 from an indoor space and through the coil assembly 100, and then blows the air past the control circuitry 1020, and out the output vent 1040.

Alternate embodiments can vary the position of these elements in different ways. For example, in alternate embodiments the control circuitry 1020 could be between the coil assembly 100 and the blower 1010. Alternatively, the control circuitry 1020 could be adjacent to an input vent 1030, 1130 and the coil assembly 100 or the blower 1030 could be adjacent to the output vent 1040.

As shown in FIGS. 10 and 11, the input vent 1030, 1130 can be in different positions on the air conditioner 1000, 1100. The precise position of the input vent 1030, 1130 can depend upon how the air conditioner will be arranged at installation. Furthermore, although both FIGS. 10 and 11 show the output vent 1040 as being in the same location, alternate embodiments could move the placement of the output vent 1040, e.g., placing it on a different side of the air conditioner casing 195 adjacent to the control circuitry 1020.

Operation of the Coil Assembly in Different Orientations

When the coil assembly 100 is in the first orientation, the first vertical drain pan 150 is located beneath the direct expansion coil 110. Input air drawn from the indoor space is drawn into the coil assembly 100 through the opening 158 in the first vertical drain pan 150. This input air is cooled by exchanging heat with cold refrigerant passing through the direct expansion coil 110, causing moisture to condense onto the direct expansion coil 110 from the input air.

The moisture that condenses onto the direct expansion coil 110 and flows down the lower sides of the direct expansion coil 110 and into the drain area 760 of the first vertical drain pan 150 near where the direct expansion coil 110 is secured to the first vertical drain pan 150. Since the moisture generally flows down the bottom side of the direct expansion coil 110, it will not drip into the opening 158 in the vertical drain pan 150. This is further aided by the fact that there is a constant flow of air passing from the opening 158 toward the direct expansion coil 110 that pushes the moisture toward the direct expansion coil 110.

Water in the first vertical drain pan 150 is then routed toward the one or more first vertical drain pan drains 180, where it is ultimately provided to an external drain or drainage area.

Any moisture that is blown away from the direct expansion coil 110 in the direction of the reheat coil 115 by the passage of the air through the coil assembly 100 will be intercepted by the second vertical drain pan 160, where it will eventually drip back onto the direct expansion coil 110 and can ultimately drain into the first vertical drain pan 150.

When the coil assembly is in the second orientation (as shown in FIG. 2), the first horizontal drain pan 120 is located beneath the direct expansion coil 110. Input air drawn from the indoor space is drawn into the coil assembly 100 through the opening 158 in the first vertical drain pan 150. This input air is cooled by exchanging heat with a cold refrigerant passing through the direct expansion coil 110, causing moisture to condense onto the direct expansion coil 110 from the input air.

The moisture that condenses onto the direct expansion coil 110 flows down the lower side of the direct expansion coil 110 and into the drain area 560 of the first horizontal drain pan 120 near where the direct expansion coil 110 is secured to the first vertical drain pan 150.

Water in the first horizontal drain pan 120 is then routed toward the one or more first horizontal drain pan drains 170, where it is ultimately provided to an external drain or drainage area.

Any moisture that is blown away from the direct expansion coil 110 in the direction of the reheat coil 115 by the passage of the air through the coil assembly 100 will be intercepted by the second vertical drain pan 160. This moisture will be routed by the first vertical drain pan 160 to the one or more second vertical drain pan drains 185 where it will ultimately be provided to an external drain or drainage area.

When the coil assembly is in the third orientation (as shown in FIG. 3), the second horizontal drain pan 125 is located beneath the direct expansion coil 110. Input air drawn from the indoor space is drawn into the coil assembly 100 through the opening 158 in the first vertical drain pan 150. This input air is cooled by exchanging heat with a cold refrigerant passing through the direct expansion coil 110, causing moisture to condense onto the direct expansion coil 110 from the input air.

The moisture that condenses onto the direct expansion coil 110 flows down the lower side of the direct expansion coil 110 and into the drain area 560 of the second horizontal drain pan 125 near where the direct expansion coil 110 is secured to the first vertical drain pan 150.

Water in the second horizontal drain pan 125 is then routed toward the one or more second horizontal drain pan drains 175, where it is ultimately provided to an external drain or drainage area.

Any moisture that is blown away from the direct expansion coil 110 in the direction of the reheat coil 115 by the passage of the air through the coil assembly 100 will be intercepted by the second vertical drain pan 160. This moisture will be routed by the second vertical drain pan 160 to the one or more second vertical drain pan drains 185 where it will ultimately be provided to an external drain or drainage area.

When the coil assembly is in the fourth orientation (a second vertical orientation), the second vertical drain pan 160 is located beneath the direct expansion coil 110. Input air drawn from the indoor space is drawn into the coil assembly 100 through the opening 158 in the first vertical drain pan 150. This input air is cooled by exchanging heat with a cold refrigerant passing through the direct expansion coil 110, causing moisture to condense onto the direct expansion coil 110 from the input air.

The moisture that condenses onto the direct expansion coil 110 flows down toward the point of the direct expansion coil 110 and into the second vertical drain pan 160 near where the direct expansion coil 110 approaches the second vertical drain pan 160.

Water in the second vertical drain pan 160 will be routed by the second vertical drain pan 160 to the one or more second vertical drain pan drains 185 where it will ultimately be provided to an external drain or drainage area.

In this way, the coil assembly 100 can properly drain moisture from the direct expansion coil 110 in at least four different orientations. Furthermore, by using the first vertical drain pan 150 and the first and second horizontal drain pans 120, 125 as the structure that holds the direct expansion coil 110 and the reheat coil 115 in place, the coil assembly 100 provides this flexibility in a compact package. This reduces the complexity of the coil assembly 100 and saves money for construction of the coil assembly 100, thereby allowing for a smaller and cheaper air conditioner in general.

Method of Assembling a Coil Assembly

Figure 12:
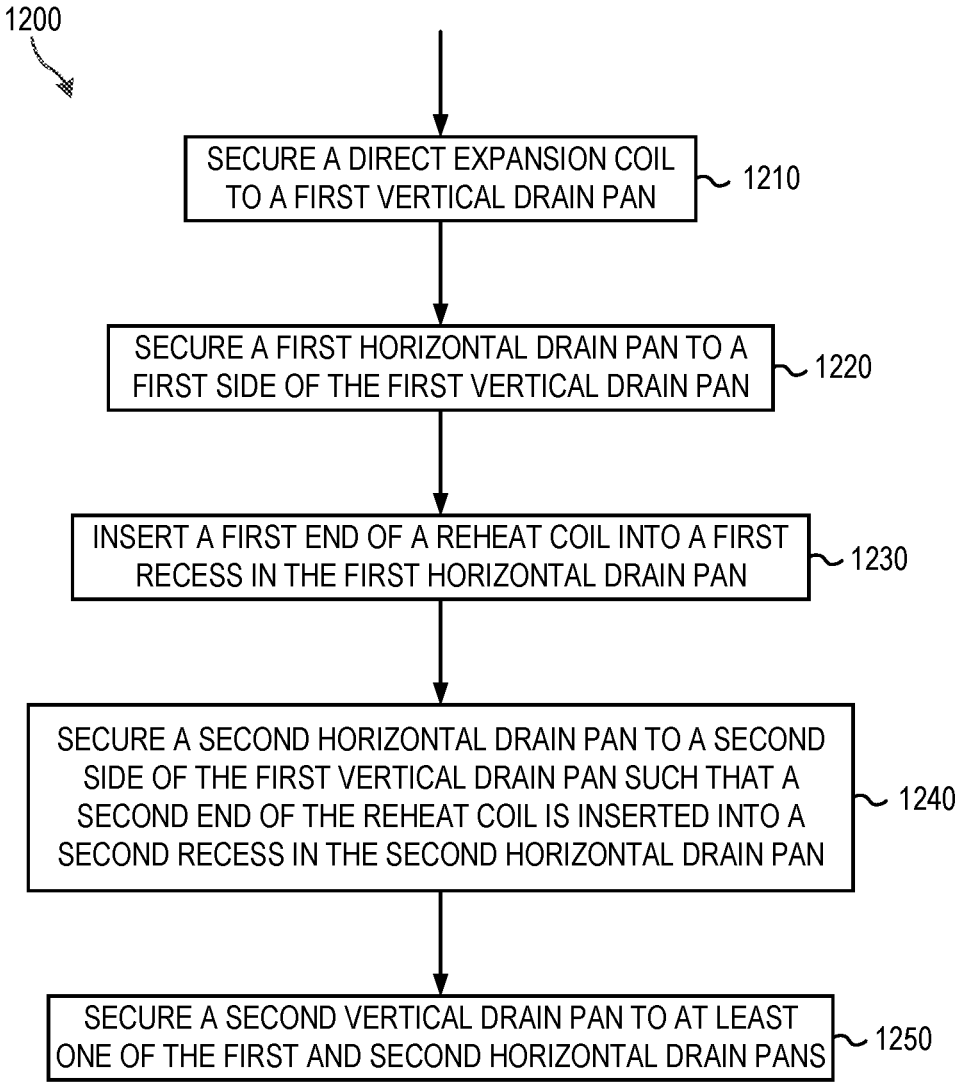
FIG. 12 is a flow chart of a method of assembling a coil assembly according to disclosed embodiments.

FIG. 12 is a flow chart of a method 1200 of assembling a coil assembly according to disclosed embodiments.

As shown in FIG. 12, a direct expansion coil is secured to a first vertical drain pan. (1210) This can be achieved using a connection mechanism such as a bolt or a clamp to secure the direct expansion coil to the first vertical drain pan, or by having the direct expansion coil directly affixed to the first vertical drain pan if the direct expansion coil and the first vertical drain pan are designed for such a connection. For example, the first vertical drain pan and the direct expansion coil could be designed to have interlocking elements that allow them to be attached to each other without external hardware.

A first horizontal drain pan is then secured to a first side of the first vertical drain pan. (1220) This can be achieved using a connection mechanism such as a bolt or a clamp to secure the first horizontal drain pan to the first vertical drain pan, or by having the first horizontal drain pan directly affixed to the first vertical drain pan if the first horizontal drain pan and the first vertical drain pan are designed for such a connection. For example, the first vertical drain pan and the first horizontal drain pan could be designed to have interlocking elements that allow them to be attached to each other without external hardware.

A first end of a reheat coil is then inserted into a recess in the first horizontal drain pan. (1230) This first recess is designed to secure the first end of the reheat coil so that it cannot easily move out of the first recess in any direction but the direction it was inserted.

A second horizontal drain pan is then secured to a second side of the first vertical drain pan such that a second end of the reheat coil opposite the first end is inserted into a second recess in the second horizontal drain pan. (1240) This second recess is designed to secure the second end of the reheat coil so that it cannot easily move out of the second recess in any direction but the direction it was inserted.

The securing of the second horizontal drain pan to the first vertical drain pan can be achieved using a connection mechanism such as a bolt or a clamp to secure the second horizontal drain pan to the first vertical drain pan, or by having the second horizontal drain pan directly affixed to the first vertical drain pan if the second horizontal drain pan and the first vertical drain pan are designed for such a connection. For example, the first vertical drain pan and the second horizontal drain pan could be designed to have interlocking elements that allow them to be attached to each other without external hardware.

Since the first and second horizontal drain pans are both secured to the first vertical drain pan such that the reheat coil is located between them, and the reheat coil can only move out of the first or second recess in the direction it was inserted, the reheat coil cannot move from its position between the first and second horizontal drain pans. This secures the reheat coil in place with a minimum of structure. This is possible since the reheat coil is roughly the same width as the first vertical drain pan so it cannot slip out of the recesses formed in the first and second horizontal drain pans.

A second vertical drain pan is then secured to at least one of the first and second horizontal drain pans. (1250) The second vertical drain pan is arranged in an opposite side of the direct expansion coil from the first vertical drain pan.

Conclusion

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

The invention claimed is:

1. A coil assembly for an air conditioner, comprising:

a direct expansion coil configured to circulate refrigerant and to cool supply air passing over the direct expansion coil by heat exchange between the refrigerant and the supply air to generate dehumidified air;

a reheat coil configured to circulate the refrigerant to heat the dehumidified air by heat exchange between the refrigerant and the supply air to generate output air;

a first horizontal drain pan configured to be located below the direct expansion coil and the reheat coil when the air conditioner is in a first horizontal position;

a second horizontal drain pan configured to be located below the direct expansion coil and the reheat coil when the air conditioner is in a second horizontal position;

a first vertical drain pan configured to be located below the direct expansion coil and the reheat coil when the air conditioner is in a vertical position, wherein the first and second horizontal drain pans are connected to the first vertical drain pan, the reheat coil is secured between the first and second horizontal drain pans, the direct expansion coil is a hot-gas direct expansion coil, and the first horizontal drain pan is arranged on an opposite side of the direct expansion coil and the reheat coil from the second horizontal drain pan.

2. The coil assembly recited in claim 1, further comprising:

one or more fasteners configured to secure the direct expansion coil to the first vertical drain pan.

3. The coil assembly recited in claim 1, wherein the first horizontal drain pan includes a first shelf extending between two first horizontal drain pan walls and configured to create a first recess, the second horizontal drain pan includes a second shelf extending between two second horizontal drain pan walls and configured to create a second recess, a first end of the reheat coil is inserted into the first recess, a second end of the reheat coil is inserted into the second recess, and the first and second horizontal drain pans are secured to the first vertical drain pan such that the reheat coil is held in place by the first and second recesses.

4. The coil assembly recited in claim 3, wherein the first shelf is formed to be contiguous with at least two walls of the first horizontal drain pan, and the second shelf is formed to be contiguous with at least two walls of the second horizontal drain pan.

5. The coil assembly recited in claim 1, wherein the first vertical drain pan includes a plurality of outer walls, a plurality of inner walls, and a first vertical drain pan bottom formed in an area between the plurality of outer walls and the plurality of inner walls, an opening is formed below the direct expansion coil between the plurality of inner walls, and first and second portions of the direct expansion coil are secured to corresponding walls selected from the plurality of outer walls and the plurality of inner walls in the area between the plurality of outer walls and the plurality of inner walls.

6. The coil assembly recited in claim 5, further comprising:

one or more fasteners configured to secure the direct expansion coil to the corresponding walls selected from the plurality of outer walls and the plurality of inner walls.

7. The coil assembly recited in claim 1, wherein the first horizontal drain pan is secured to the first vertical drain pan proximate to the first portion of the direct expansion coil, and the second horizontal drain pan is secured to the first vertical drain pan proximate to the second portion of the direct expansion coil.

8. The coil assembly recited in claim 1, further comprising:

a second vertical drain pan configured to be located between the direct expansion coil and the reheat coil, wherein a first width of the first vertical drain pan in a width direction between the first horizontal drain pan and the second horizontal drain pan extends substantially an entire distance between the first horizontal drain pan and the second horizontal drain pan, and a second width of the second vertical drain pan in the width direction is narrower than the first width of the first vertical drain pan.

9. The coil assembly recited in claim 1, wherein the refrigerant is configured to change state between liquid and vapor during an air-conditioning cycle that passes the refrigerant through the direct expansion coil and the reheat coil.

10. The coil assembly recited in claim 1, wherein the reheat coil is set apart from the direct expansion coil.

11. The coil assembly recited in claim 10, wherein the reheat coil is arranged between 1 inch and 6 inches apart from the direct expansion coil.

12. The coil assembly recited in claim 1, wherein the direct expansion coil is an A-coil.

13. The coil assembly recited in claim 1, wherein the first and second horizontal drain pans are substantially the same size and shape.

14. An air conditioner, comprising:

the coil assembly recited in claim 1;

a blower configured to blow input air across the coil assembly;

a controller configured to control operation of the coil assembly and the blower; and an air conditioner casing formed around the coil assembly, the blower, and the controller.

15. A drain pan for use in an air conditioner, comprising:

a drain pan bottom;

a first drain pan wall formed along a first side of the drain pan bottom;

a second drain pan wall formed along a second side of the drain pan bottom;

a third drain pan wall formed along a third side of the drain pan bottom;

a fourth drain pan wall formed along a fourth side of the drain pan bottom;

a drain hole formed in one of the first through fourth drain pan walls; and an interior drain pan wall extending between the third and fourth drain pan walls to divide an interior of the drain pan into a drain area and a coil recess, wherein the coil recess is isolated from the drain area such that liquid cannot flow from the drain area into the coil recess.

16. The drain pan recited in claim 15, wherein a drain length of the drain area in a length direction between the first wall and the second wall is greater than a recess length of the coil recess in the length direction.

17. A method of assembling a coil assembly for an air conditioner, comprising:

securing a direct expansion coil to a first vertical drain pan;

securing a first horizontal drain pan to a first side of the first vertical drain pan;

inserting a first end of a reheat coil into a first recess in the first horizontal drain pan; and securing a second horizontal drain pan to a second side of the first vertical drain pan opposite the first side of the first vertical drain pan such that a second end of the reheat coil is inserted into a second recess in the second horizontal drain pan, wherein the first and second horizontal drain pans are secured to the first vertical drain pan in such a manner that the reheat coil is held in place by the first and second recesses.

18. The method recited in claim 17, wherein the first and second horizontal drain pans are secured to the first vertical drain pan such that the direct expansion coil is located between the first horizontal drain pan and the second horizontal drain pan.

19. The method recited in claim 17, wherein the first horizontal drain pan is secured to the first vertical drain pan such that a first horizontal drain pan bottom of the first horizontal drain pan is substantially perpendicular to a first vertical drain pan bottom of the first vertical drain pan, and the second horizontal drain pan is secured to the first vertical drain pan such that a second horizontal drain pan bottom of the second horizontal drain pan is substantially perpendicular to the first vertical drain pan bottom of the first vertical drain pan.

20. The method recited in claim 17, further comprising securing a second vertical drain pan to at least one of the first horizontal drain pan and the second horizontal drain pan such that the second vertical drain pan is formed on an opposite side of the direct expansion coil from the first vertical drain pan.

* * * * *